US011312459B2

(12) United States Patent
Jordan et al.

(10) Patent No.: US 11,312,459 B2
(45) Date of Patent: Apr. 26, 2022

(54) OUTBOARD MOTOR SUPPORT

(71) Applicants: Brian Jordan, Jacksboro, TN (US); Michael Smith, Jacksboro, TN (US); Alan Wright, Clinton, TN (US)

(72) Inventors: Brian Jordan, Jacksboro, TN (US); Michael Smith, Jacksboro, TN (US); Alan Wright, Clinton, TN (US)

( * ) Notice: Subject to any disclaimer, the term of this patent is extended or adjusted under 35 U.S.C. 154(b) by 51 days.

(21) Appl. No.: 16/796,507

(22) Filed: Feb. 20, 2020

(65) Prior Publication Data

US 2020/0262535 A1 Aug. 20, 2020

Related U.S. Application Data

(60) Provisional application No. 62/854,042, filed on May 29, 2019, provisional application No. 62/808,024, filed on Feb. 20, 2019.

(51) Int. Cl.
*B63H 20/00* (2006.01)
*B63H 20/06* (2006.01)

(52) U.S. Cl.
CPC ..... *B63H 20/06* (2013.01)

(58) Field of Classification Search
None
See application file for complete search history.

(56) References Cited

U.S. PATENT DOCUMENTS

| | | | | |
|---|---|---|---|---|
| 2,584,955 A | | 2/1952 | Williams | |
| 2,905,132 A | | 9/1959 | Lewis et al. | |
| 2,939,670 A | | 6/1960 | Anderson | |
| 2,977,084 A | | 3/1961 | Brown et al. | |
| 3,598,348 A | | 8/1971 | Kickhaefer | |
| 3,941,344 A | | 3/1976 | Paterson | |
| 3,952,986 A | | 4/1976 | Wells | |
| 4,331,431 A | | 5/1982 | Estes | |
| 4,366,954 A | | 1/1983 | Cash et al. | |
| 4,448,387 A | | 5/1984 | Gilbreath | |
| 4,501,561 A | | 2/1985 | Speelman | |
| D282,144 S | * | 1/1986 | Speelman | D8/349 |
| 4,650,427 A | | 3/1987 | Huchinson | |
| 4,682,959 A | | 7/1987 | MacGregor | |
| 4,763,871 A | | 8/1988 | Probst | |
| 4,778,417 A | * | 10/1988 | Mixon, Jr. | B63H 20/06 248/641 |

(Continued)

FOREIGN PATENT DOCUMENTS

| | | | |
|---|---|---|---|
| CA | 568390 | A | 1/1959 |
| DE | 102007035655 | A1 | 1/2009 |
| WO | WO2006016874 | A1 | 2/2004 |

*Primary Examiner* — Steven M Marsh
(74) *Attorney, Agent, or Firm* — Pitts & Lake, P.C.

(57) ABSTRACT

A device to support an outboard motor in a raised position, the device including an elongated support body having first and second ends, a coupling member provided at the first end of the support body and configured to be removably coupled to a stern bracket, and a pair of stabilizing members coupled proximate the second end of the support body, wherein the second end of the support body is configured to contact a motor bracket to maintain the outboard motor in the raised position, and wherein the pair of stabilizing members are configured to be fixable in a position to contact opposite sides of the outboard motor to stabilize the outboard and inhibit lateral movement.

3 Claims, 6 Drawing Sheets

(56) References Cited

U.S. PATENT DOCUMENTS

| | | | | |
|---|---|---|---|---|
| 4,842,239 | A * | 6/1989 | Kinsey | B63H 20/36 248/351 |
| 5,021,016 | A | 6/1991 | Currey | |
| 5,031,842 | A | 7/1991 | Mohr | |
| 5,041,032 | A | 8/1991 | Makihara et al. | |
| 5,048,449 | A | 9/1991 | Templeman | |
| 5,107,786 | A | 4/1992 | Templeman | |
| 5,525,082 | A | 6/1996 | Lee et al. | |
| 5,609,506 | A | 3/1997 | Williams, Jr. | |
| 5,647,781 | A | 7/1997 | Johnson, Sr. | |
| 5,662,307 | A | 9/1997 | Lentine | |
| 5,758,594 | A | 6/1998 | Siewert | |
| 5,775,669 | A | 7/1998 | Huggins et al. | |
| 5,795,202 | A | 8/1998 | Williams | |
| 5,857,660 | A | 1/1999 | Lentine | |
| 5,888,109 | A | 3/1999 | Poll | |
| 6,513,782 | B2 | 2/2003 | Fischer | |
| RE39,414 | E | 11/2006 | Poll | |
| 7,278,893 | B1 | 10/2007 | Frantz | |
| 7,335,073 | B1 | 2/2008 | Christian | |
| 8,096,521 | B1 | 1/2012 | Smith | |
| 9,145,194 | B2 | 9/2015 | Marks et al. | |
| 9,776,699 | B1 * | 10/2017 | Alby | B63H 20/06 |
| 2001/0044243 | A1 * | 11/2001 | Thompson | B63H 20/36 440/55 |
| 2008/0029683 | A1 | 2/2008 | Draghici | |
| 2008/0169404 | A1 | 7/2008 | Smith | |
| 2009/0098783 | A1 * | 4/2009 | Cribbs | B63H 20/06 440/63 |
| 2012/0006966 | A1 * | 1/2012 | Mynster | B63H 20/08 248/642 |
| 2013/0221187 | A1 | 8/2013 | Marks et al. | |

* cited by examiner

OUTBOARD MOTOR SUPPORT

CROSS-REFERENCE TO RELATED APPLICATIONS

This application claims the benefit of U.S. Provisional Patent Application Ser. No. 62/808,024, filed on Feb. 20, 2019, and U.S. Provisional Patent Application Ser. No. 62/854,042, filed on May 29, 2019, each of which are incorporated herein in their entirety by reference.

FIELD OF INVENTION

The present general inventive concept relates to an outboard motor support, and, more particularly, to an outboard motor support to interact with an outboard motor bracket.

BACKGROUND

When transporting a boat having an outboard motor, it is beneficial to provide additional support for maintaining the motor in a raised position so that the trim control is not solely responsible for such support during travel. A conventional method for providing such support is a motor mate that braces the motor against a stern bracket by mating or interacting with exposed bolts on the motor housing. However, several recently designed motors do not have such exposed bolts, and therefore a need exists for an outboard motor support that can function without such an exposed bolt fitting, and without damaging the motor housing. Further, a need exists for such an outboard motor support that can include stabilizing elements to prevent a supported outboard motor from lateral movement while braced.

BRIEF SUMMARY

According to various example embodiments of the present general inventive concept, an outboard motor support is provided to provide support for a raised motor between the stern and motor brackets without contacting the outboard motor housing. Various example embodiments also provide additional stabilizing elements which can brace the motor housing to prevent lateral movement of the outboard motor during towing.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a device to support an outboard motor in a raised position, the device including an elongated support body having first and second ends, and a coupling member provided at the first end of the support body and configured to be selectively coupled to a stern bracket, wherein the second end of the support body is configured to abut a motor bracket to maintain the outboard motor in the raised position.

The foregoing and/or other aspects and advantages of the present general inventive concept may also be achieved by providing a device to support an outboard motor in a raised position, the device including an elongated support body having first and second ends, a coupling member provided at the first end of the support body and configured to be removably coupled to a stern bracket, and a pair of stabilizing members coupled proximate the second end of the support body, wherein the second end of the support body is configured to contact a motor bracket to maintain the outboard motor in the raised position, and wherein the pair of stabilizing members are configured to be fixable in a position to contact opposite sides of the outboard motor to stabilize the outboard and inhibit lateral movement.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and photographs, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
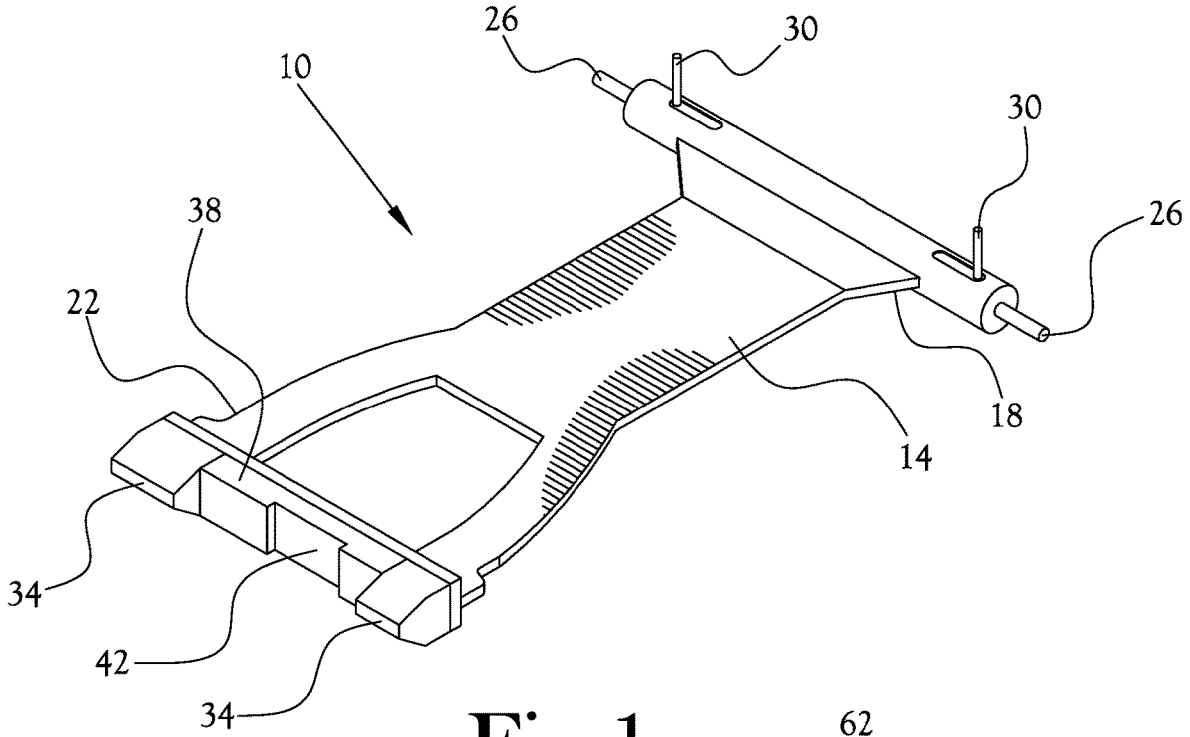
FIG. 1 illustrates an outboard motor support according to an example embodiment of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Outboard motors are typically mounted on bracket systems that include a boat bracket attached to the boat, referred to herein as a stern bracket, and a motor bracket attached to the outboard motor. The stern bracket and motor bracket are coupled together in a hinged manner so that the trim of the outboard motor can be adjusted during operation of the boat. As previously discussed, to keep the motor in a raised position during travel and other related out of water times, motor supports that are clipped to the stern bracket can be mated with exposed bolts on the motor housing, or drive shaft housing, to brace the position of the raised motor. However, many more recently developed motors, such as the four stroke Mercury 250 and 150 horsepower motors, do not have such exposed bolts, and therefore have no mating means in the conventional sense. Such outboard motors are difficult, if not impossible, to support with the conventional motor supports, as these supports could scratch, crack, or otherwise damage the motor housing. According to various example embodiments of the present general inventive concept, an outboard motor support is provided that is able to interact with the stern bracket and the motor bracket to brace the outboard motor without touching the motor housing, and therefore not causing any damage, cosmetic or otherwise, to the motor. Various example embodiments also provide additional stabilizing elements which can brace the motor housing to prevent lateral movement of the outboard motor during towing without damaging the motor housing.

FIG. 1 illustrates an outboard motor support according to an example embodiment of the present general inventive concept. As shown in the example embodiment illustrated in FIG. 1, the outboard motor support 10 includes an elongated support body 14 having a first end 18 and a second end 22, the first end 18 and second end 22 being configured to interact respectively with the stern bracket and the motor bracket that are coupled to one another and attached to the stern of the boat. In various example embodiments the support body 14 may be formed of, for example, ⅜" steel and may be powder coated. In various example embodiments one or both of the first and second ends 18,22 may be provided with vibration damping materials, such as, for example, plastic, to contact the respective stern and motor brackets. In the example embodiment illustrated in FIG. 1, the first end 18 of the support body 14 may be provided with a conventional spring-loaded retractable 2-pin assembly in which the two retractable pins 26 are arranged to be received in holes of the stern bracket to secure the first end 18 of the support body 14 to the stern bracket. Thus, typically a user can attach the first end 18 to the stern bracket by retracting the oppositely disposed pins 26 using the corresponding pin handles 30, positioning the first end 18 such that the pins 26 are aligned with the facing holes in the stern bracket, and releasing the pin handles 30 so that the respective springs push the pins 26 into the respective receiving holes of the stern bracket. With such a connection, a user can leave the outboard motor support 10 attached to the stern bracket of the boat even when not being used, as the outboard motor support 10 can simple hang freely from the pin connection. It is understood that a host of different coupling configurations can be used to attach the first end 18 of the support body 14 to the stern bracket without departing from the scope of the present general inventive concept. The second end 22 of the support body 14 is configured to abut or otherwise contact the motor bracket, and may be provided with the aforementioned vibration damping material that is different than that of the main body of the motor support. The second end 22 may have one or more extending members 34 that are configured to abut the motor bracket when the outboard motor support 10 is positioned to brace the motor in the upright position. In the example embodiment illustrated in FIG. 1, the damping member on the second end 22 of the support body 14 is provided with a vibration damping member 38 that is configured with the two extending members 34 that terminate in flat and rectangular ends that are formed to be received by corresponding indentations of the motor bracket of the four stroke Mercury 250 motor, but various example embodiments may be arranged to fit different motor brackets of different outboard motors. The extending members 34 on the second end 22 of the support body 14 are configured to be received in indentations or grooves of the motor bracket, and when received therein lateral movement relative to the motor bracket is inhibited while the outboard motor support 10 braces the outboard motor in the raised position. The extending members 24 may be formed of the vibration damping material to dampen vibration at the point of contact between the extending members 34 and the motor bracket. In the example embodiment illustrated in FIG. 1, a recessed portion 42 between the extending members 34 allows a mid-portion of the motor bracket, between the indentations or grooves receiving the extending members 34, to not contact the motor support 10. In other various example embodiments, the recessed portion between the extending members 34 may be configured to also contact one or more portions of the motor bracket between the grooves to provide additional support and enhanced vibration damping for even smoother support during transit. The main support body 14 of the motor support 10 may be configured in a host of configurations that may be different from the example embodiment illustrated in FIG. 1, such as, for example, a skeletal and/or tubular arrangement. In various example embodiments of the present general inventive concept, much or all of the support body 14 itself may also be formed of a vibration damping material, either the same or different than dampers located at either end of the support body 14.

Figure 2:
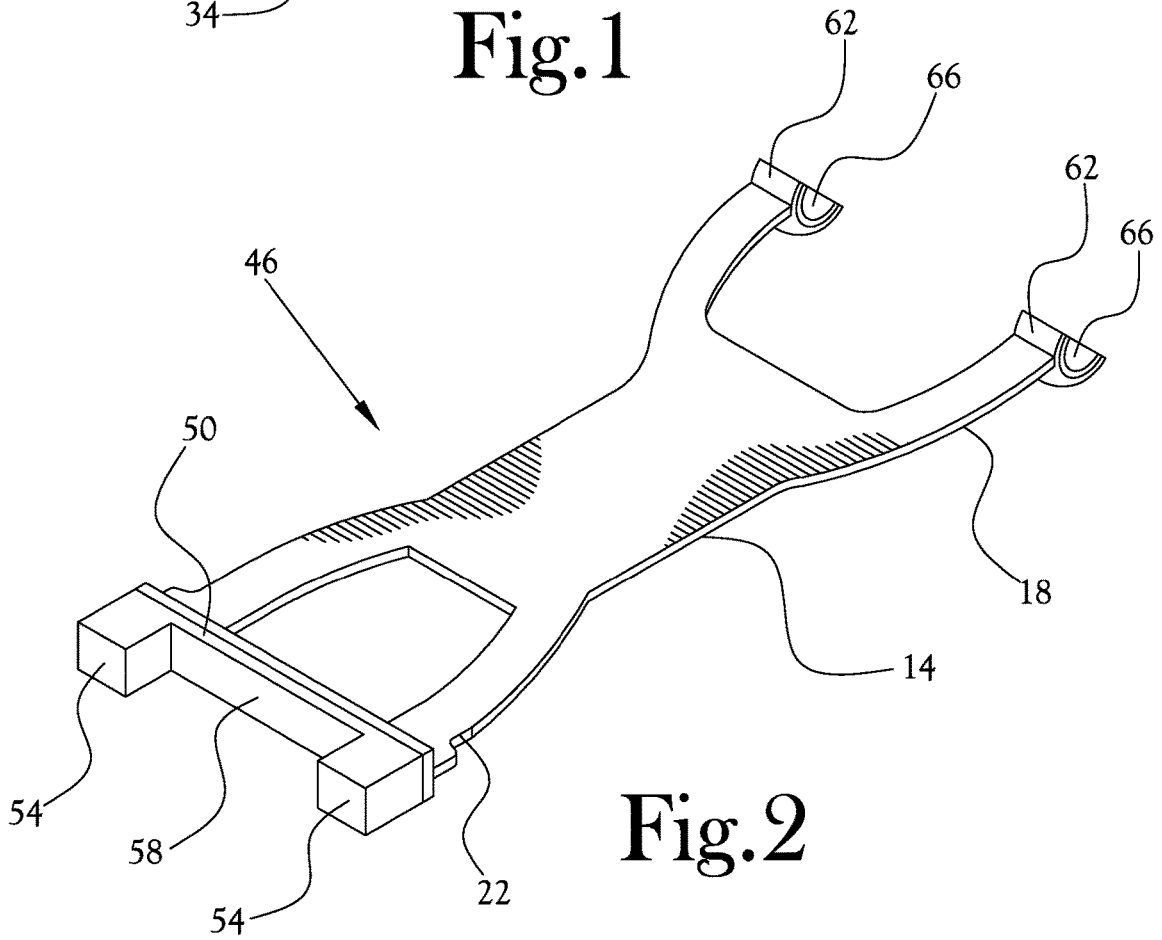
FIG. 2 illustrates an outboard motor support according to another example embodiment of the present general inventive concept.

FIG. 2 illustrates an outboard motor support 46 according to another example embodiment of the present general inventive concept. In the example embodiment illustrated in FIG. 2, the second end 22 of the motor support 46 is configured to be received by grooves of a different motor bracket, such as the four stroke Mercury 150. The second end 22 of the support body 14 is provided with a vibration damping member 50 that is formed with two substantially similar extending members 54 that may are formed to fit into corresponding indentations or grooves of the motor bracket, and a recessed portion 50 that extends with a substantially flat configuration therebetween on the surface configured to face the motor bracket. A host of different configurations may be used for the second end 22 to interact or mate with the motor bracket. In various example embodiments of the present general inventive concept, the vibration damping configuration of the second end 22 may even be interchangeably coupled to the support body 14 so that different motor brackets may use the motor support. Such interchangeable vibration damping members could be bolted or screwed onto the second end 22 of the support body 14, slidably connected, adhesively adhered, and so on. As illustrated in FIG. 2, the first end 18 of the motor support 46 is provided with two arcuate portions 62, which may be referred to herein as saddle joints or saddle joint portions 62, that are configured to lay over similarly arcuate surfaces, such as bosses or other extending members, of the stern bracket. For example, the stern bracket for the four stroke Mercury 150 may have two inward projections from the sides of the stern bracket, and the saddle joint portions 62 of the motor support 46 may be formed to simply lay over the inward projections to form a saddle joint fitting that provides the brace support, but is also easy to engage and disengage with one hand. The inner surface of the saddle joint portions 62 may be formed with a vibration damping material 66, which may or may not be the same as that used on the second end 22 of the motor support 46, to dampen vibrations at the point of contact with the stern bracket. Although the saddle joint 62 arrangement is illustrated in the example embodiment of FIG. 2, it will be understood that such an arrangement may also be used in the example embodiment of FIG. 1, as the first and second ends 18,22 of various example embodiment supports may be formed in a host of different configurations as desired for different respective stern and motor brackets.

Figure 3:
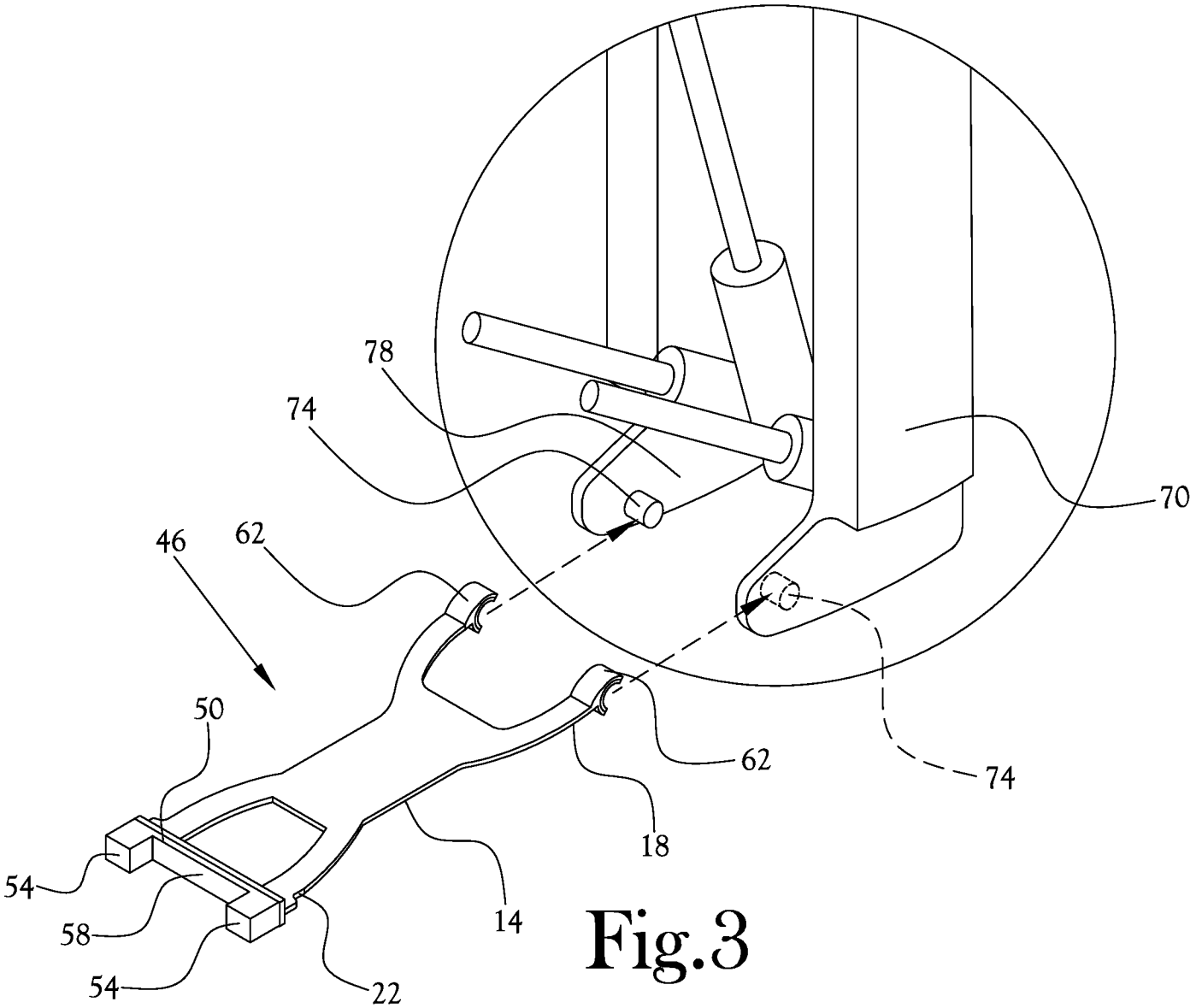
FIG. 3 illustrates a saddle type coupling of the outboard motor support of FIG. 2 and a stern bracket.
Figure 4:
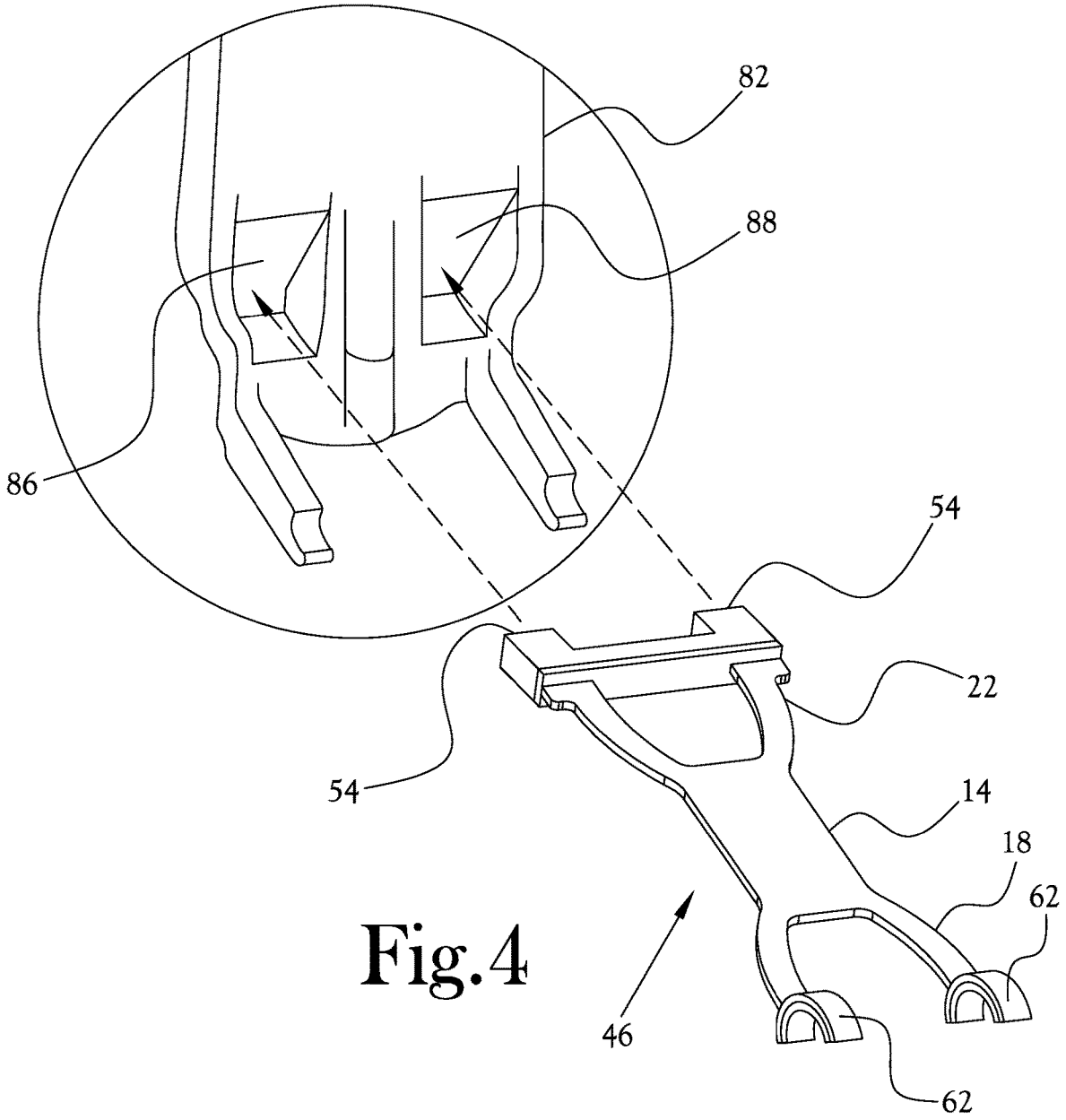
FIG. 4 illustrates a support fitting of the outboard motor support of FIG. 2 and a motor bracket.
Figure 5:
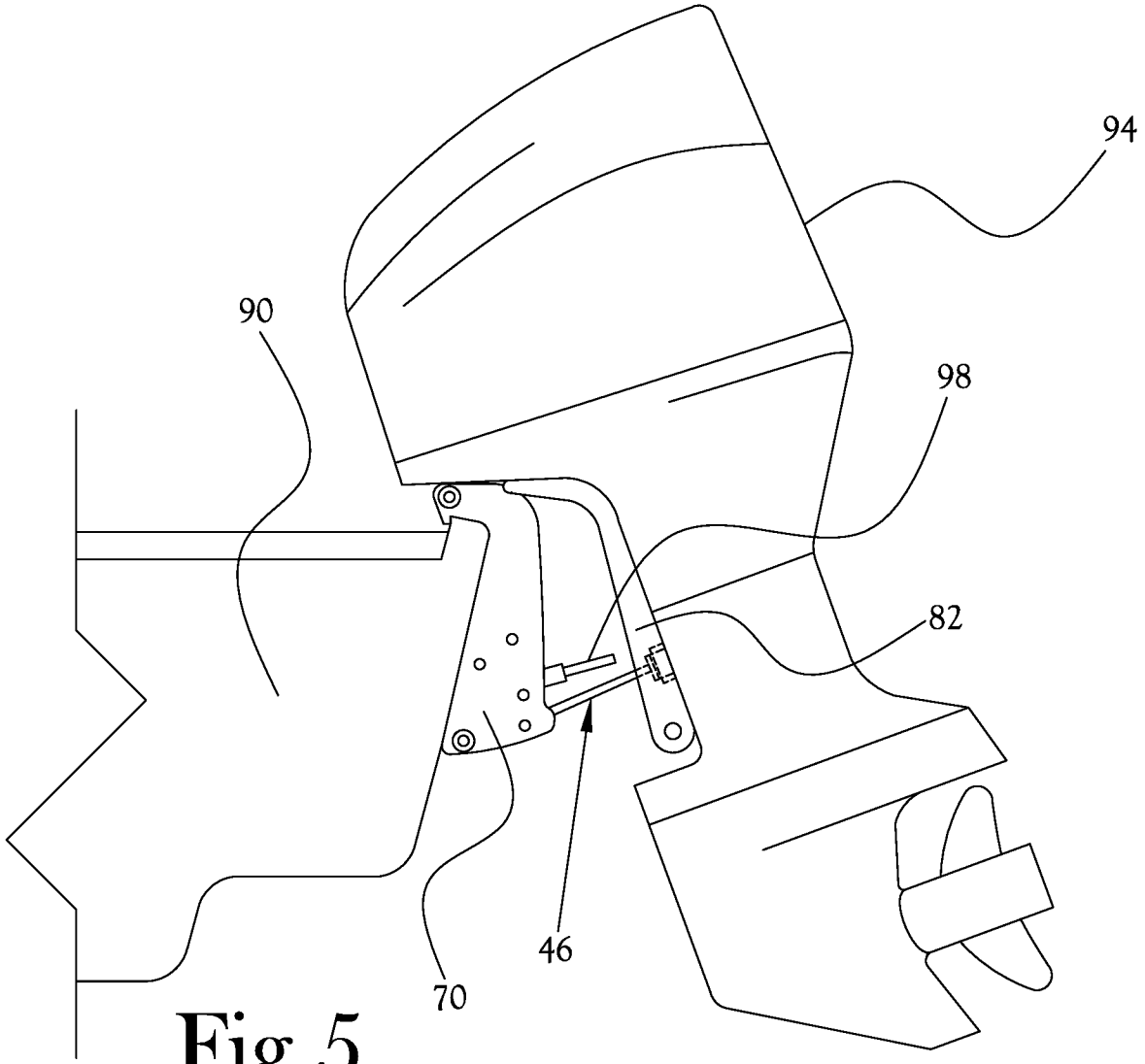
FIG. 5 illustrates an outboard motor being supported in a raised position according to an example embodiment of the present general inventive concept.

FIG. 3 illustrates a saddle type coupling of the outboard motor support 46 of FIG. 2 and a stern bracket 70. As illustrated in FIG. 3, the saddle joint portions 62 formed at the first end 18 of the support body 14 of the outboard motor support 46 are simply placed over the knobs 74, ears, bosses, etc., that are extending from inner side portions 78 of the illustrated stern bracket 70. As illustrated, the inner arcuate portions of the saddle joints 62 are configured to be able to receive the knobs 74 therein and then contact the knobs 74 along a substantially continuous surface of a portion of the knobs 74, making for easy and convenient installation and removal of the saddle joints 62 while still maintaining a strong support surface when deployed on the knobs 74. After positioning the saddle joints 62 over the knobs 74, the motor support 46 may be rotated to the point at which the second end 22 of the support body 14 interacts with the desired portion of the motor bracket. FIG. 4 illustrates a support fitting of the outboard motor support 46 of FIG. 2 and a motor bracket 82. As illustrated, two recesses (or indentations or grooves) 86 are formed in the motor bracket 82, and the extending members 54 on the second end 22 of the support body 14 are configured to be received in those grooves 86 in almost a mating fashion. As the lateral ends of the extending members 54 abut the rear surface of the grooves 86 of the motor bracket 82, support is provided by the motor support 46 to hold the motor in an upright position. Additionally, the extending members 54 may be formed such that the side surfaces of the extending members 54 contact or sit in close proximity with one or more of the side surfaces of the grooves 86 of the motor support 82, thereby inhibiting lateral movement of the motor during transportation of the boat. FIG. 5 is a side view illustrating an outboard motor 94 being supported in a raised position according to an example embodiment of the present general inventive concept. As illustrated in FIG. 5, the stern bracket 70 is attached to a stern portion of a boat 90, the outboard motor 94 is attached to the motor bracket 82, and the outboard motor 94 is being supported in a raised position due to the interaction between the outboard motor support 46 and the stern and motor brackets 70,82. As illustrated, the motor support 46 is only in contact with the stern bracket 70 and the motor bracket 82, and thus the outboard motor 94 is supported in the raised position without any contact between the motor support 46 and the motor 94 or motor casing itself, and also without any support by the trim control body 98. With such an arrangement, there is no pressure or abrasive contact between the motor support 46 and the motor 94 or motor casing, thus preventing damage that could occur by having such contact.

Even with the outboard motor supports shown in the example embodiments described herein, there may be situations in which it is desirable to have more support to further inhibit lateral movement of the outboard motor during travel. For example, even with the vibration damping material provided to one or both ends of the example outboard motor supports shown and described herein, rough travel may cause the outboard motor to rock from side to side, and in some cases may even be severe enough to lose contact with one or more portions of the support member. In some current arrangements, steering clips that clip into the top of hydraulic cylinders are used to try and keep the outboard motor from swaying laterally, but such an arrangement leaves much to be desired. Therefore, various example embodiments of the present general inventive concept may also include stabilizing members that can contact the sides of the motor housing to stabilize the outboard motor and inhibit such lateral movement.

Figure 6:
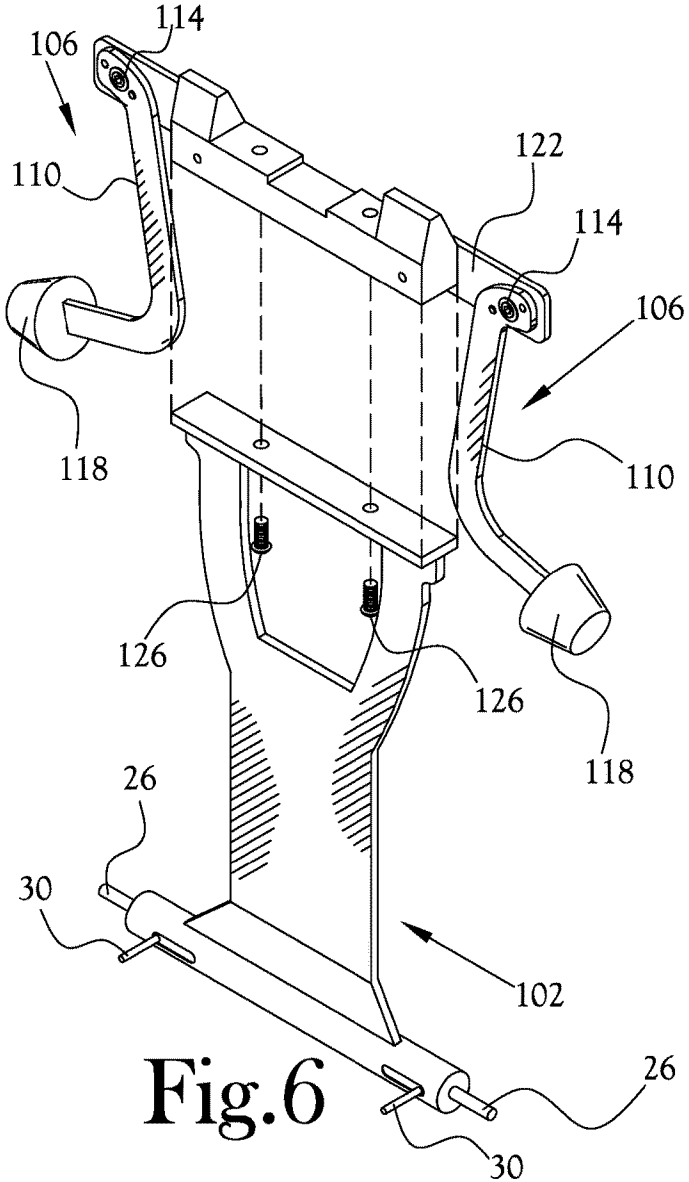
FIG. 6 illustrates an exploded view of an outboard motor support with stabilizing members according to an example embodiment of the present general inventive concept.

FIG. 6 illustrates an exploded view of an outboard motor support 102 with stabilizing members 106 according to an example embodiment of the present general inventive concept. In this example embodiment, the stabilizing members 106, which may be referred to interchangeably herein as stabilizing arms 106, are selectively positionable relative to the remaining portion of the outboard motor support 102 so as to be able to be moved around to contact side portions of the outboard motor 94, or outboard motor casing. In various example embodiments, the stabilizing members 106 may include arms 110 that may be configured to pivot about coupling points with some portion of the outboard motor support 102 to contact the outboard motor 94 at locations proximate the contact points between the outboard motor support 102 and the motor bracket 82. The stabilizing arms 110 may have vibration damping members 118 or other such padding or cushioning members arranged at the distal ends of the stabilizing arms 110 to inhibit any potential contact damage with the outboard motor 94. Example embodiments of the stabilizing arms 110 may be configured such that the distal ends, or vibration damping members 118 provided at the distal ends, fit into somewhat corresponding recessed areas of the outboard motor casing, so as to provide a good fit and have more stabilizing support. In various example embodiments, the vibration damping members 118 may be formed of the same vibration damping material provided at one or both ends 18,22 of the outboard motor support 102. In various example embodiments of the present general inventive concept, the stabilizing arms 110 may be provided with securing arrangements so selectively fix the stabilizing arms in a first position for storage, and in a second position for stabilizing the outboard motor 94 in transit.

Figure 7:
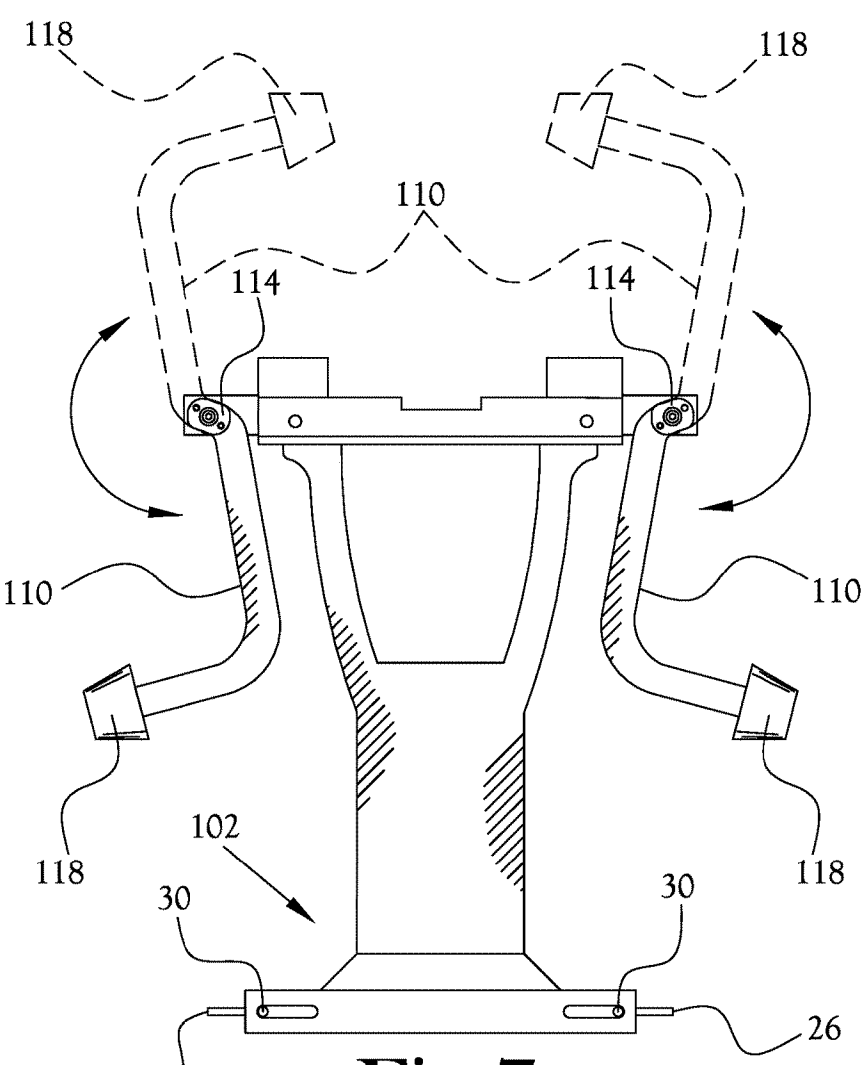
FIG. 7 illustrates different positions of the stabilizing members of FIG. 6 according to an example embodiment of the present general inventive concept.

FIG. 7 illustrates different positions of the stabilizing members 106 of FIG. 6 according to an example embodiment of the present general inventive concept. As illustrated in FIG. 7, in the first position the stabilizing arms 110 are drawn back so as to not needlessly protrude outward from the second end 22 of the outboard motor support 102, and are rotatable to the second position in which the stabilizing arms 110, due to their curved or bent configuration, may wrap around at least a portion of the lower motor casing to contact the motor casing to inhibit lateral movement of outboard motor 94 in transit. It is understood that various example embodiments of the present general inventive concept may provide stabilizing arms 110 and/or distal cushioning members 118 that may be configured in a host of different shapes, sizes, and materials without departing from the scope of the present general inventive concept.

In the example embodiment illustrated in FIGS. 6-7, the stabilizing arms 110 are coupled to the outboard motor support 102 by being pivotally attached to a cross member 122 that is itself fixed to the vibration damping member 38 provided at the second end 22 of the outboard motor support 102. In this example embodiment, the cross member 122 is attached to the vibration damping member 38 such that the opposite ends of the cross member 122 extend further outward than the ends of the vibration damping member 38, and the stabilizing arms 110 are pivotably coupled to the respective opposite ends of the cross member 122. Such an arrangement may be desirable in some cases so that the stabilizing arms assembly may be retrofitted to the outboard motor support of the example embodiments described herein, and possibly other outboard motor supports of different configurations. In some cases of retrofitting, the cross member 122 may be secured directly to the vibration damping member 38 already existing on the outboard motor support, by any of a number of securing members such as screws, etc. In other cases of retrofitting, the stabilizing arms assembly may include a replacement vibration damping member or other such abutting member already fixed to the cross member 122, so that a user can simply change out the abutting or damping member from the existing outboard motor support and replace it with the assembly as illustrated in FIG. 6. In such a case, as illustrated in FIG. 6, screws 126 or other securing members may be threaded through a portion of the second 22 end of the outboard motor support 102 and directly into the vibration damping member 38 in the same way that the previously provided vibration damping member 38 was secured to the second end 22 of the outboard motor support 102. In various example embodiments a cross member 122 spanning the entirety of the second end may not be used, and rather two smaller members may be connected proximate opposite sides of the vibration damping member 38, or the support body 14 itself, extending laterally to provide the pivoting connections 114 for the stabilizing arms 110. The vibration damping member 38 may be formed of UHMW in various example embodiments of the present general inventive concept. In various example embodiments, the stabilizing arms 110 or stabilizing arms assembly may be manufacture along with, or retro-fitted to, conventional outboard motor supports that interact with the previously described exposed bolts or other types of contacts. In such retro-fitting, the stabilizing arms 110 may be coupled directly to the support body 14, to a cross member 112 coupled to the motor support 102, and so on.

In various other example embodiments of the present general inventive concept, the stabilizing arms 110 may be directly coupled to other portions of the outboard motor support, such as at locations inset from the second end 22 of the outboard motor support. In some example embodiments, the cross member 122 may be omitted. However, in other example embodiments, the cross member configuration may still be used to provided further rigid structure as a base for the stabilizing arms 110. Although the stabilizing arms 110 are shown as projecting outwards from the sides of the outboard motor support 102 in FIG. 7 when retracted to the first position, it is understood that in some example embodiments the first position of the stabilizing arms 110 may be arranged so that the entire outboard motor support assembly is more compact, with the stabilizing arms 110 retracted completely within the side edges of the support for easier storage with less required space. In various example embodiments of the present general inventive concept in which the cross member 122 is provided and connected to the vibration damping member 38, the front facing edge of the cross member 122 may be configured with one or more recessed portions so as not to extend further than corresponding portions of the vibration damping member 38 itself, so that the cross member 122 does not contact the motor bracket 82 or motor housing. For example, as illustrated in FIGS. 6-7, the forward edge of the cross member 122 is recessed substantially in line with the recessed portion 42 of the vibration damping member 38 so that the cross member 122 cannot be seen past the forward edge of the vibration damping member 38.

Figure 8A:
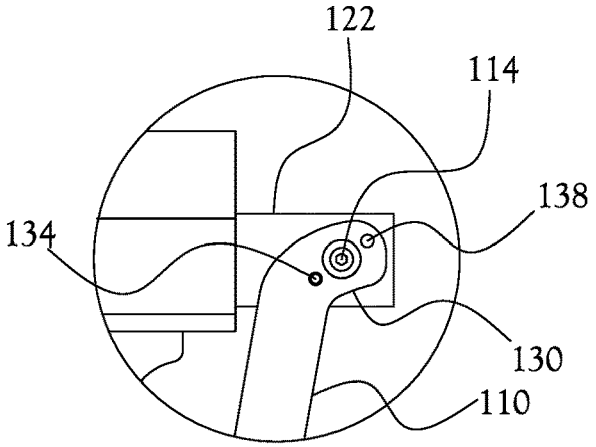
FIGS. 8A-B illustrate securing configurations for the different stabilizing member positions of FIG. 7 according to an example embodiment of the present general inventive concept.
Figure 8B:
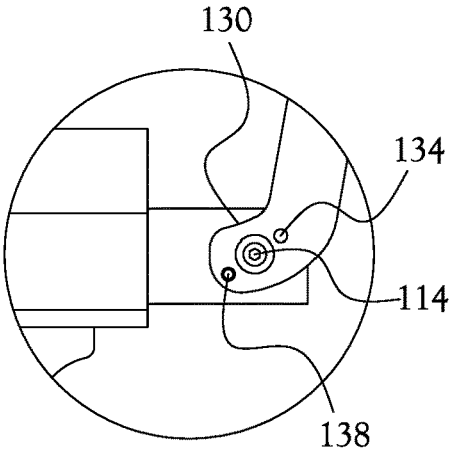
Figure 9A:
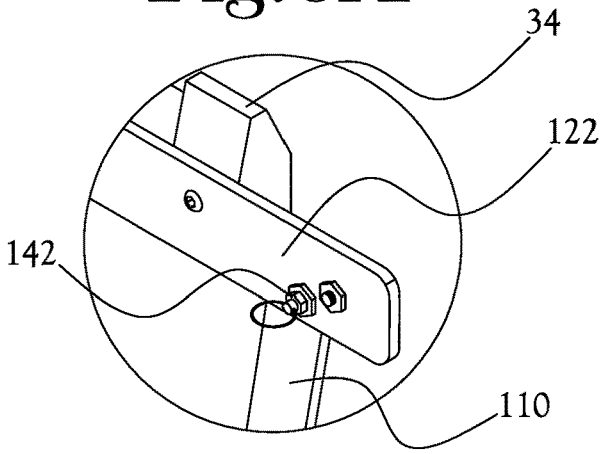
FIGS. 9A-B illustrate an operation of a pin assembly used in the securing configuration of FIG. 8A according to an example embodiment of the present general inventive concept.
Figure 9B:
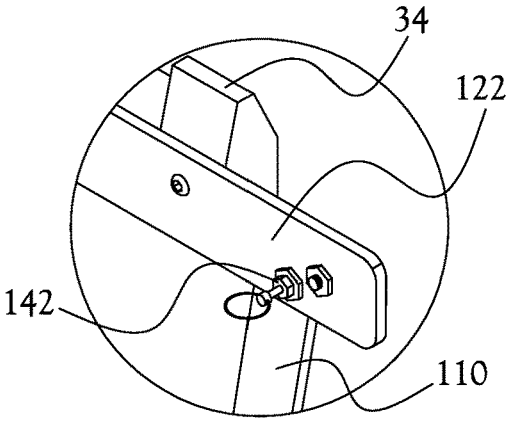
Figure 10:
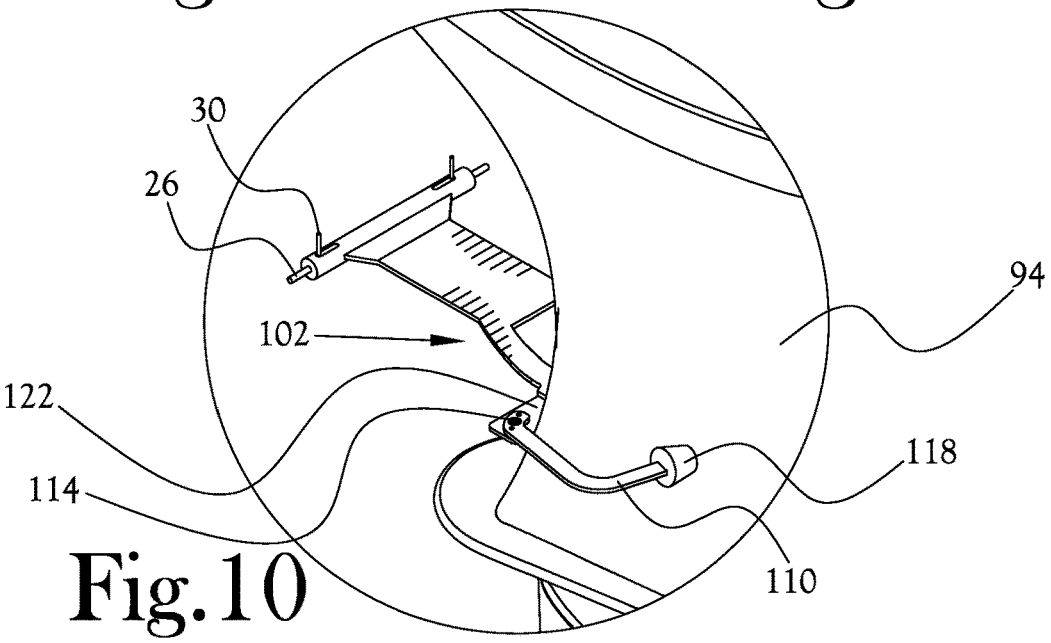
FIG. 10 illustrates an outboard motor being supported and stabilized in a raised position according to an example embodiment of the present general inventive concept.

FIGS. 8A-B illustrate securing configurations for the different stabilizing member positions of FIG. 7 according to an example embodiment of the present general inventive concept. As illustrated in FIGS. 8A-B, respective proximal ends 130 of the stabilizing arms 110 are coupled to the opposite ends of the cross arm 122 by the pivoting connection 114 that allows the stabilizing arms 114 to pivot about the pivoting connections 114 between the previously described first and second positions. First and second through holes 134,138 are provided at different locations about the pivoting connection 114 to allow the stabilizing arms 110 to be secured in place in the first or second position. Such a securing action may be provided with, for example, a spring-loaded retractable pin 142 that is received in the first or second through holes 34,138 depending upon the position of the stabilizing arms 110. FIGS. 9A-B illustrate an operation of a spring-loaded retractable pin 142 assembly used in the securing configuration of FIG. 8A according to an example embodiment of the present general inventive concept. To secure the stabilizing arms 110 in the first position, in which the stabilizing arms 110 are retracted, the spring-loaded retractable pin 142 is passed through the first through hole 134 as shown in FIG. 9A. In more detail, if the spring-loaded retractable pin 142, which is biased in the direction going through the cross arm to the stabilizing arm 110 on the other side, has been pulled out and the stabilizing arm 110 rotated around to the first position, the distal end of the spring-loaded retractable pin 142 abuts a surface of the proximal end 130 of the stabilizing arm 110 away from either of the first and second through holes 134,138. Then, as the stabilizing arm 110 is rotated about to the first position, the biased retractable pin 142 goes through the first through hole 134 to secure the stabilizing arm 110 in the first position, as shown in FIGS. 8A and 9A. To move the stabilizing arm 110 to the second position, the user would simply pull the retractable pin 142 away from the cross member 122, as shown in FIG. 9B, until it is no longer protruding through the first through hole 134, and then rotate the stabilizing arm 110 around to the second position, at which point the pin 142 can be released to go through the second through hole 138, locking the stabilizing arm 110 in the second position, as shown in FIG. 8B. The user can release the retractable pin 114 upon starting to rotate the stabilizing arm 110, as the distal end of the pin 114 will be biased toward the stabilizing arm 110 and drop into the through hole of the corresponding desired position as soon as the desired through hole is aligned with the retractable pin 114. Alternatively, the user may simply release the pin 114 so that the pin 114 moves into the desired through hole when the stabilizing arm 110 is in the desired position to fix the stabilizing arm 110 in place to contact and stabilize the outboard motor. In various example embodiments of the present general inventive concept, the spring-loaded pin 114 may be offset from the hinge connection. Various other example embodiments may include other types of fixing members or assemblies to hold the stabilizing member in various positions. In various example embodiments of the present general inventive concept the configuration of the stabilizing arms 110 and/or vibration damping members 118 at the distal ends of the stabilizing arms may be configured to optimally perform with a certain type of outboard motor, such as the aforementioned four stroke Mercury 250 and 150 horsepower motors. In some example embodiments, the stabilizing arms 110 may be configured so that the distal ends rest in indentures in the prescribed motor housing. FIG. 10 illustrates an outboard motor being supported and stabilized in a raised position according to an example embodiment of the present general inventive concept. As illustrated in FIG. 10, the stabilizing arms 110 are able to swing around and contact the sides of the lower motor casing, and may be fixed in that position to inhibit lateral movement of the outboard motor while being transported.

Various example embodiments of the present general inventive concept may provide a device to support an outboard motor in a raised position, the device including an elongated support body having first and second ends, and a coupling member provided at the first end of the support body and configured to be selectively coupled to a stern bracket, wherein the second end of the support body is configured to abut a motor bracket to maintain the outboard motor in the raised position. The coupling member may include at least one saddle joint configured to overlay at least a portion of stern bracket protuberance. The device may further include an abutting member provided at the second end of the support body to abut the motor bracket, wherein the abutting member is configured with one or more extending portions configured to be received in grooves formed in the motor bracket. The one or more extending portions may terminate in flat surfaces configured to contact the motor bracket in the grooves. The one or more extending portions may be formed to contact one or more side surfaces of the grooves formed in the motor bracket so as to inhibit a lateral movement of the outboard motor. The abutting member may be configured with one or more recessed portions in between the extending portions to prevent contact between the abutting member and the motor bracket between the extending portions. The abutting member may be configured with one or more recessed portions in between the extending portions, the one or more recessed portions configured to contact the motor bracket at one or more locations between the extending portions. At least one of the coupling member or the abutting member may be formed with a vibration dampening material to contact the stern bracket or motor bracket. The abutting member may be selectively attachable and detachable from the second end of the support body.

Various example embodiments of the present general inventive concept may provide a device to support an outboard motor in a raised position, the device including an elongated support body having first and second ends, a coupling member provided at the first end of the support body and configured to be removably coupled to a stern bracket, and a pair of stabilizing members coupled proximate the second end of the support body, wherein the second end of the support body is configured to contact a motor bracket to maintain the outboard motor in the raised position, and wherein the pair of stabilizing members are configured to be fixable in a position to contact opposite sides of the outboard motor to stabilize the outboard and inhibit lateral movement. The stabilizing members may be pivotable about coupling connections proximate the second end of the support body. The device may further include a contact member provided at the second end of the support body to contact the motor bracket, wherein the contact member may be formed of a vibration damping material different from the support body. The device may further include a cross member fixed to the contact member, wherein the coupling connections may be provided proximate opposite ends of the cross member. The stabilizing members may be selectively fixable at a first position in which the stabilizing members are retracted, and a second position in which the stabilizing members are contacting the outboard motor. The stabilizing members may be provided with a plurality of through holes proximate the respective coupling connections, and the device may further include a spring-loaded retractable pin to be selectively received in the through holes to fix the stabilizing members in the first or second position.

Various example embodiments of the present general inventive concept may provide a device to support an outboard motor in a raised position, the device including an elongated support body having first and second ends, a coupling member provided at the first end of the support body and configured to be coupled to a stern bracket, and an abutting member provided at the second end of the support body and configured to abut a motor bracket to maintain the outboard motor in the raised position. The coupling member may include at least one saddle joint configured to overlay at least a portion of stern bracket protuberance. The abutting member may be configured with one or more extending portions configured to be received in grooves formed in the motor bracket. The one or more extending portions may terminate in flat surfaces which contact the motor bracket in the grooves. At least one of the coupling member or the abutting member may be formed with a vibration dampening material to contact the stern bracket or motor bracket.

Various example embodiments of the present general inventive concept may provide a device to support an outboard motor in a raised position, the device including an elongated support body having first and second ends, a coupling member provided at the first end of the support body and configured to be coupled to a stern bracket, an abutting member provided at the second end of the support body and configured to abut a motor bracket to maintain the outboard motor in the raised position, and a pair of stabilizing members coupled proximate the second end of the support body and configured to be fixable in a position to contact opposite sides of the outboard motor to stabilize the outboard and inhibit lateral movement. The stabilizing members may be pivotable about coupling connections proximate the second end of the support body. The device may further include a cross member fixed to the abutting member, wherein the coupling connections are provided proximate opposite ends of the cross member. The stabilizing members may be selectively fixable at a first position in which the stabilizing members are retracted, and a second position in which the stabilizing members are contacting the outboard motor. The stabilizing members may be provided with a plurality of through holes proximate the respective coupling connections, and further comprising a spring-loaded retractable pin to be selectively received in the through holes to fix the stabilizing members in the first or second position.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A device to support an outboard motor in a raised position, the device comprising:

an elongated support body having first and second ends;

a coupling member provided at the first end of the support body and configured to be removably coupled to a stern bracket; and a pair of stabilizing members coupled proximate the second end of the support body;

wherein the second end of the support body is configured to contact a motor bracket to maintain the outboard motor in the raised position;

wherein the pair of stabilizing members are configured to be fixable in a position to contact opposite sides of the outboard motor to stabilize the outboard and inhibit lateral movement;

wherein the stabilizing members are pivotable about coupling connections proximate the second end of the support body;

wherein the stabilizing members are selectively fixable at a first position in which the stabilizing members are retracted, and a second position in which the stabilizing members are contacting the outboard motor; and wherein the stabilizing members are provided with a plurality of through holes proximate the respective coupling connections, and further comprising a spring-loaded retractable pin to be selectively received in the through holes to fix the stabilizing members in the first or second position.

2. The device of claim 1, further comprising:

a contact member provided at the second end of the support body to contact the motor bracket;

wherein the contact member is formed of a vibration damping material different from the support body.

3. The device of claim 2, further comprising a cross member fixed to the contact member, wherein the coupling connections are provided proximate opposite ends of the cross member.

* * * * *